US011065905B2

(12) United States Patent
Leibenguth et al.

(10) Patent No.: US 11,065,905 B2
(45) Date of Patent: Jul. 20, 2021

(54) METHOD FOR THE INSERTION OF GUILLOCHE PATTERNS, METHOD FOR THE EXTRACTION OF GUILLOCHE PATTERNS, METHOD FOR THE AUTHENTICATION OF THESE GUILLOCHE PATTERNS AND DEVICES FOR IMPLEMENTATION

(71) Applicant: THALES DIS FRANCE SA, Meudon (FR)

(72) Inventors: Joseph Leibenguth, Meudon (FR); Michel Jourlin, Meudon (FR); Maxime Carré, Meudon (FR); Mohamed Bouabdellah, Meudon (FR)

(73) Assignee: THALES DIS FRANCE SA, Meudon (FR)

( * ) Notice: Subject to any disclaimer, the term of this patent is extended or adjusted under 35 U.S.C. 154(b) by 0 days.

(21) Appl. No.: 16/650,959

(22) PCT Filed: Sep. 25, 2018

(86) PCT No.: PCT/EP2018/075980
§ 371 (c)(1),
(2) Date: Mar. 26, 2020

(87) PCT Pub. No.: WO2019/063556
PCT Pub. Date: Apr. 4, 2019

(65) Prior Publication Data

US 2020/0254807 A1 Aug. 13, 2020

(30) Foreign Application Priority Data

Sep. 26, 2017 (EP) ..... 17306266

(51) Int. Cl.
*B42D 25/337* (2014.01)
*B42D 25/23* (2014.01)
(Continued)

(52) U.S. Cl.
CPC ..... *B42D 25/337* (2014.10); *B42D 25/23* (2014.10); *B42D 25/305* (2014.10); *B42D 25/309* (2014.10)

(58) Field of Classification Search
CPC .... B42D 25/337; B42D 25/23; B42D 25/305; B42D 25/309; B42D 25/29; B42D 25/24
(Continued)

(56) References Cited

U.S. PATENT DOCUMENTS 4,557,596 A 12/1985 Mueller et al.
2010/0165414 A1* 7/2010 Kautto ..... B42D 25/30 358/3.28

FOREIGN PATENT DOCUMENTS

EP 2236308 A1 10/2010
EP 2325022 A1 5/2011
(Continued)

OTHER PUBLICATIONS

PCT/IB2018/057608, International Search Report, dated Feb. 22, 2019, European Patent Office, P.B. 5818 Patentlaan 2 NL-2280 HV Rijswijk.

(Continued)

*Primary Examiner* — Justin V Lewis
(74) *Attorney, Agent, or Firm* — The Jansson Firm; Pehr B. Jansson

(57) ABSTRACT

A method of inserting guilloche patterns in a document, each guilloche pattern being capable of encoding variable alphanumeric data ensuring a different aspect at each guilloche pattern so as to render said document secure using an operation of determining an insertion intensity of each guilloche pattern previously generated on the basis of a mid-gray level of the document near said guilloche pattern. A device for implementing this insertion method. The method further provides for extracting guilloche patterns
(Continued)

from a secure document likely to be degraded by determining a contrast card of at least one portion of the secure document that includes the guilloche patterns, identifying, on this contrast card an optimal percolation trajectory, and extracting the optimal percolation trajectory, said trajectory corresponding to the guilloche pattern. The method further provides for authentication of the guilloche patterns of a secure document likely to be degraded, by the extraction operations, and comparing each extracted guilloche pattern with a corresponding theoretical guilloche pattern.

24 Claims, 8 Drawing Sheets

(51) Int. Cl.

| | |
|---|---|
| ***B42D 25/305*** | (2014.01) |
| ***B42D 25/309*** | (2014.01) |
| ***B42D 25/29*** | (2014.01) |
| ***B42D 25/24*** | (2014.01) |

(58) Field of Classification Search
USPC ..... 283/67, 70, 72, 74, 75, 94, 98, 113, 901
See application file for complete search history.

(56) References Cited

FOREIGN PATENT DOCUMENTS

| | | | |
|---|---|---|---|
| WO | WO2007121726 | A2 | 11/2007 |
| WO | WO2007121726 | A3 | 11/2007 |
| WO | WO2010003948 | A1 | 1/2010 |
| WO | WO2014060700 | A1 | 4/2014 |

OTHER PUBLICATIONS

PCT/IB2018/057608, Written Opinion of the International Searching Authority, Feb. 22, 2019, European Patent Office, D-80298 Munich, Germany.

PCT/EP2018/075980, International Search Report, dated Dec. 7, 2018, European Patent Office, P.B. 5818 Patentlaan 2 NL-2280 HV Rijswijk.

PCT/EP2018/075980, Written Opinion of the International Searching Authority, dated Dec. 7, 2018, European Patent Dffice, D-80298 Munich, Germany.

* cited by examiner

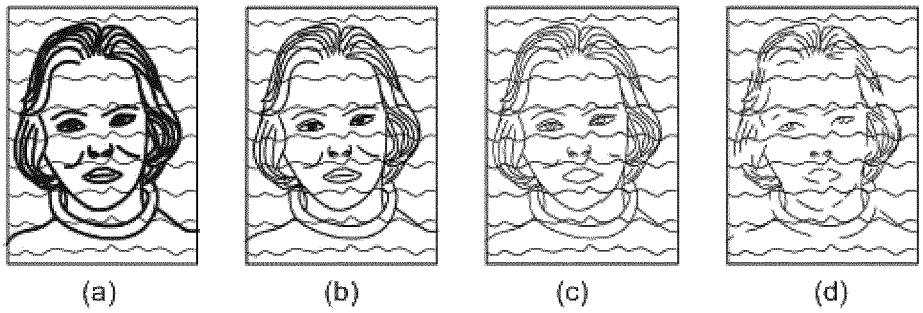
Fig. 1
Fig. 3
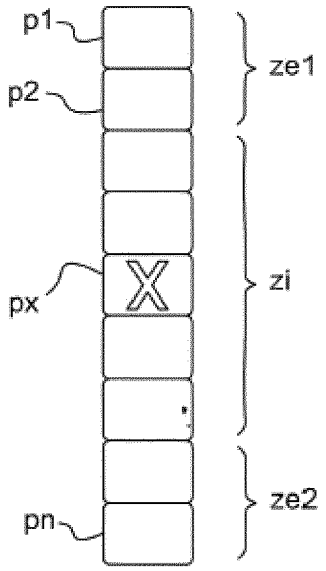

METHOD FOR THE INSERTION OF GUILLOCHE PATTERNS, METHOD FOR THE EXTRACTION OF GUILLOCHE PATTERNS, METHOD FOR THE AUTHENTICATION OF THESE GUILLOCHE PATTERNS AND DEVICES FOR IMPLEMENTATION

TECHNICAL FIELD

The present invention concerns a method for inserting guilloche patterns containing coded data and a device for inserting said guilloche patterns. It also concerns a method for extracting and authenticating guilloche patterns containing encoded data. It also concerns an authentication device as well as a secure document needing to be authenticated such as an identity card, a driving license, a notarial deed, etc. The invention has applications in the field of secure documents and, in particular, the authentication of secure documents even when these are damaged.

STATE OF THE ART

In a known way, security documents, like identity documents for example, generally comprise an identity photograph of their holder as well as alphanumeric data such as, for example, the name of the holder, his date of birth, his height, his address, the document number, the date of issue of the document and/or the identity of the authority that issued the document.

In order to render identity documents secure, it is known to associate the identity photograph with guilloches. These guilloches form a network of undulating lines superimposed on the photograph and visible to the naked eye. The guilloches are intended to make discernable, during an identity check, any fraudulent modification of the photograph. In particular, they make it possible to defend against changes in color of the photograph, for example when a beard or hair is added. Thus, guilloches generally enable the performance of level 1 (visual check with the naked eye) and/or level 2 (visual check with a simple optical device such as a magnifying glass or ultraviolet light) security checks.

Moreover, it is also known to implement means of protecting the alphanumeric data mentioned in identity documents in order to defend against alternations to these data such as, for example, modifications of these alphanumeric references.

The protection of alphanumeric data can be achieved by digital tattooing techniques (known as watermarking) intended to incorporate elements invisible to the naked eye into an identity photograph, these elements coding predefined information. Watermarking provides level 3 security (automatic verification of encoded data) during a security check. Thus, by means of a digital processing and analysis device, the identity photograph is analyzed and the data that are watermarked therein are extracted. A verification of the consistency of these data is then performed.

However, watermarking has a certain number of drawbacks. In fact, since it is not visible to the naked eye, watermarking does not enable a level 1 or 2 security check to be performed. The verification of watermarked secure documents therefore requires trained personnel, equipped with large means of analysis, which limits the security checks, particularly mobile checks. Furthermore, watermarks can be sensitive to degradations of the identity document, degradations that can be caused, during the period of validity of the document, by natural wear, exposure to UV rays, lack of care by the holder, etc. The analysis of degraded watermarks can then result in an incorrect reading of the watermarks, or the impossibility of reading them during the check.

Another known technique also makes it possible to render said alphanumeric data mentioned in the identity documents secure. This technique proposes to insert, in the identity photograph, variable guilloches encoding all or part of the alphanumeric data. Examples of methods of rendering documents secure by using such variable guilloches are specifically described in patent applications EP 2 325 022 A1 and US 2010/0260372 filed in the name of the applicant.

These guilloches must enable the implementation of both a level 1 and a level 3 security check. To implement a level 1 security check, the guilloches must not interfere with the visual perception of the underlying content of the document, particularly the photograph, and must not prevent good readability of the characteristic traits of the holder of the secure document.

Furthermore, and in a compatible manner, the guilloches must be sufficiently marked in order to be able to be extracted automatically by means of an authentication device and thus meet the requirements of security level 3. In fact, the implementation of security level 3 requires, prior to any extraction of the guilloches, a phase of printing the photograph onto the document then a phase of scanning the image formed of the photograph and of the superimposed guilloches. Now, these so-called "print-scan" phases generate a double degradation of the quality of the image, the degree of degradation depending in particular on the quality of the print-scan system. An example of an original image and its degraded images is shown in FIG. 1. In particular, image (a) in FIG. 1 represents an example of an original digital image, comprising a photograph of the holder of a secure document on which guilloches are superimposed. Images (b), (c) and (d) represent the image (a) degraded by a print-scan system of high quality, of average quality and of low quality, respectively. In addition to the double print-scan degradation, the secure documents tend to undergo additional degradations during their period of validity, such as natural wear, the effects of UV rays, physical aggressions, etc. Also, so that the automatic extraction of the guilloches, at security level 3, do not suffer from the degradations undergone by the security document, it is important that these guilloches are inserted in a sufficiently marked manner within the document.

Furthermore, in order to implement a security level 3 check, the guilloches affixed to the photograph must be capable of being extracted automatically by means of an authentication device so that they can be checked and/or authenticated. A level 3 verification/authentication of a document rendered secure by guilloches requires, prior to any extraction of the guilloches, a phase of printing the photograph onto the document then a phase of scanning the image formed of the photograph and the superimposed guilloches. Now, these print-scan phases cause a double degradation of the quality of the image, the degree of degradation depending chiefly on the quality of the print-scan system. An example of an original image and its degraded images is represented in FIG. 6. In particular, image (a) of FIG. 6 represents an example of an original digital image, comprising a photograph of the holder onto which guilloches are superimposed. Images (g), (h) and (j) represent image (a) degraded by a print-scan system, of high quality, medium quality and low quality, respectively.

Furthermore, like any secure document, documents rendered secure by guilloches undergo additional degradations during their period of validity, such as natural wear, the effects of UV rays, physical aggressions, etc.

The double degradation of the print-scan phase, to which can be added additional degradations, has the effect of impeding the extraction of the guilloches, which makes it impossible to check/authenticate the alphanumeric data encoded in the guilloches and compromises the implementation of level 3 security.

SUMMARY OF THE INVENTION

In order to address the above-mentioned dual problem of readability with the naked eye of the document with guilloches and of extraction of the guilloches when the secure document is degraded, the applicant proposes to insert the guilloches, or guilloche patterns, with an insertion intensity determined on the basis of the level of mid-gray of the document near the guilloche patterns.

In order to address the above-mentioned problem of the impossibility of checking a document rendered secure by guilloches when the quality of the guilloches is degraded, the applicant proposes to extract the guilloches, or guilloche patterns, based on trajectories generated on the basis of the contrasts of the secure document.

According to a first aspect, the invention concerns a method of inserting guilloche patterns in a document, each guilloche pattern being capable of encoding variable alphanumeric data ensuring a different aspect at each guilloche pattern so as to render said document secure. This method is characterized in that it comprises an operation of determining an insertion intensity of each guilloche pattern previously generated on the basis of a mid-gray level of the document near said guilloche pattern.

This method enables the guilloche patterns to be inserted with an intensity that depends on the gray level of the document in the place where the guilloche pattern is affixed. The marking of the guilloche pattern on the document is thus more or less marked and depends on the photographic environment.

This method can be applied to all sorts of secure documents. It can be applied in particular:

- to identity documents such as identity cards, passports, driving licenses, etc., where the guilloche patterns are usually applied onto the holder's photograph,
- to secure documents with or without a photograph, such as civil status documents, notarial deeds (known as "breeder documents") or mobile identity documents (known as "mobile ID" documents), where the entire document contains guilloche patterns, or
- to documents for the protection of brands ("brand protection" documents) or other physical marking (for example packaging and luxury goods) for which authentication of origin is required.

Advantageously, the insertion intensity of a guilloche pattern involves a contrast value and a thickness of said guilloche pattern. Varying the thickness and contrast of a guilloche pattern allows said pattern to be more or less marked on the document.

According to certain embodiments, determining the insertion intensity of the guilloche pattern involves a calculation operation, in each pixel of said guilloche pattern, of the contrast value between an internal area of the guilloche pattern and an external area near said internal area.

According to one or more embodiments, the contrast value is obtained by comparison between the mid-gray level of the internal area and the mid-gray area of the external area.

According to certain embodiments, the comparison between the mid-gray level of the internal area and the mid-gray level of the external area is achieved by Logarithmic Image Processing (or LIP).

According to certain embodiments, determining the insertion intensity of the guilloche pattern involves an operation of selecting a thickness of the guilloche pattern.

According to certain embodiments, the external area is an area of pixels adjacent to the internal area.

According to certain embodiments, the guilloche pattern is a sinusoidal pattern, affixed substantially horizontally to the document, the external area being positioned vertical to the pixel or pixels of the guilloche pattern.

According to certain embodiments, the guilloche pattern is a series of ridges corresponding to a digital fingerprint, for example that of the holder of the document, the internal and external areas being positioned along a normal to the curve at the pixel in question. According to a second aspect, the invention concerns a device for the insertion of guilloche patterns into a document, comprising a computer containing a set of instructions that prompt said computer to implement the method for inserting guilloche patterns as described above. This device enables guilloche patterns to be inserted with a more or less marked marking depending on the photographic environment.

According to a third aspect, the invention concerns a secure document onto which are affixed guilloche patterns encoding alphanumeric data, characterized in that the guilloche patterns are inserted into the document by the insertion method described above.

According to a fourth aspect, the invention concerns an identity document comprising an identity photograph and alphanumeric data relating to the holder, characterized in that the identity photograph contains in a visible manner guilloche patterns coding the alphanumeric data, inserted by the insertion method described above.

According to a fifth aspect, the invention concerns a method for extracting guilloche patterns from a secure document likely to be degraded, the method comprising the following operations:

- determining a contrast card of at least one portion of the secure document that includes guilloche patterns;
- identifying, on this contrast card, an optimal percolation trajectory; and
- extracting the optimal percolation trajectory, said trajectory corresponding to the guilloche pattern.

This method allows guilloche patterns to be extracted even when they are difficult to perceive with the naked eye. It therefore allows guilloche patterns to be extracted from secure documents that have undergone degradations.

This method can apply to all sorts of secure documents. It can apply in particular:

- to identity documents such as identity cards, passports, driving licenses, etc., where the guilloche patterns are usually applied to the photograph of the holder,
- to secure documents with or without a photograph, such as civil status documents, notarial deeds (known as "breeder documents") or mobile identity documents (known as "mobile ID" documents), where the entire document contains guilloche patterns, or
- to documents for the protection of brands ("brand protection" documents) or other physical marking (for example packaging and luxury goods) for which authentication of origin is required.

Advantageously, the contrast card is created by means of a Logarithmic Image Processing (LIP) model. This LIP model allows the contrasts that are compatible with human vision to be determined.

According to certain embodiments, the operation of identifying the optimal percolation trajectory involves:

identifying, on the contrast card, all of the trajectories likely to pass across the secure document in order to connect a point of departure of a guilloche pattern to a point of arrival of said pattern;

determining a cost function of each of the trajectories, said cost function assessing a variability of the contrast between the contrast determined for each trajectory and an expected contrast;

comparing the cost functions of all of the trajectories; and determining the minimal cost function, the trajectory comprising the minimal cost function corresponding to the guilloche pattern.

According to one or more embodiments, when the document and in particular the photograph is in color, the contrast card is calculated on the basis of the luminance image associated with the color image.

According to a sixth aspect, the invention concerns a method of authentication of the guilloche patterns of a secure document likely to be degraded, this method involving:

operations for extracting the guilloche patterns previously defined, and an operation of comparing each extracted guilloche pattern with a corresponding theoretical guilloche pattern.

This method of authentication allows a secure document to be checked at security level 3, even when the secure document is damaged and/or the quality of the guilloche patterns is degraded.

According to one or more embodiments, when each guilloche pattern encodes the variable alphanumeric data mentioned in said secure document, the theoretical guilloche pattern is obtained by Optical Character Recognition (OCR) of the alphanumeric data mentioned in the secure document and by generating the corresponding theoretical patterns.

According to some embodiments, when the secure document comprises an electronic chip, the theoretical guilloche pattern is an original guilloche pattern, previously stored in the chip when generating the guilloche pattern affixed to the secure document.

According to one or more embodiments, the operation of comparing the extracted and theoretical patterns involves estimating a score based on a distance between each point of the extracted guilloche pattern and a corresponding point of the theoretical guilloche pattern.

According to a variation, the score is calculated by accumulating the distances for all of the points of the guilloche pattern.

According to certain embodiments, the distance is calculated on the basis of the number of pixels.

According to certain embodiments, a weight is assigned to each distance, the long distances having a greater weight than the short distances. This weight can be adjusted.

According to a seventh aspect, the invention concerns a device for authenticating guilloche patterns comprising a computer containing a set of instructions that prompt said computer to implement the above-described method for authenticating the guilloche patterns.

According to an eighth aspect, the invention concerns an identity document comprising alphanumeric data relating to the holder and an identity photograph to which are affixed guilloche patterns encoding the alphanumeric data, characterized in that the guilloche patterns can be authenticated by the method defined above.

BRIEF DESCRIPTION OF THE FIGURES

Further features and advantages of the invention will emerge from reading the description, illustrated by the Figures in which:

FIG. 1, previously described, represents an example of an original secure document and deteriorated secure documents;

FIG. 3 represents an example of a section of a guilloche pattern from which the contrast value is calculated;

DETAILED DESCRIPTION OF AT LEAST ONE EMBODIMENT

Figure 2:
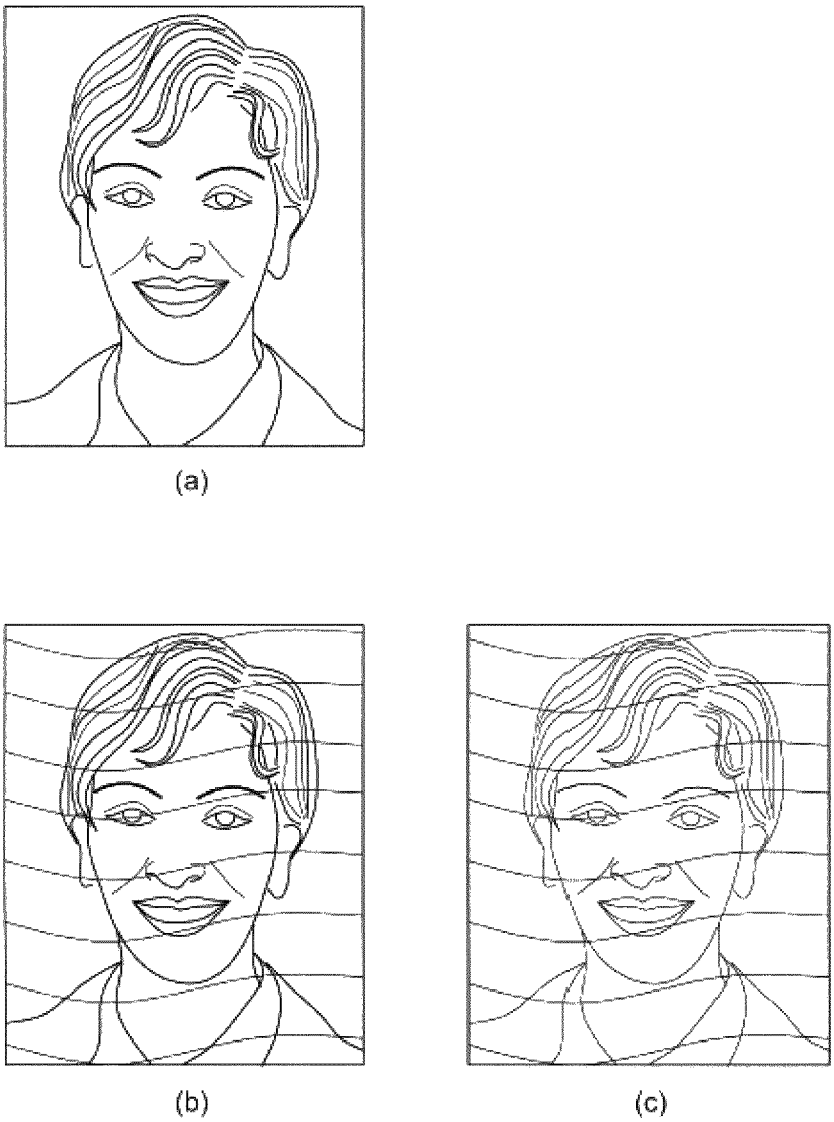
FIG. 2 represents an example of an original photograph, of this same photograph with guilloches and of this secure photo after printing and scanning.

An example of an embodiment of a method for inserting guilloche patterns in a secure document is described in detail below, with reference to the accompanying drawings. An example of an embodiment of a method for authenticating guilloche patterns of a secure document, even when said secure document is degraded, is also described in detail below, with reference to the accompanying drawings. These examples show the features and advantages of the invention. It should be remembered, however, that the invention is not limited to these examples.

In the Figures, identical elements bear the same reference numerals. For ease of readability of the Figures, no size scale between the elements shown is observed.

The method of the invention proposes to insert guilloche patterns such as those previously mentioned in one portion of or over the entire secure document. In the following description, the method will be described when it is applied to a portion of a secure document such as a photograph on which are superimposed the guilloche patterns, also called guilloches. In the description, the word "photograph" shall be understood as referring indiscriminately to a portion of secure document or an underlying content. A person skilled in the art will also understand that the method as it will be described can also be implemented for a document of which the entirety of said document comprises guilloche patterns.

These guilloche patterns are, for example, one-dimensional patterns, or 1D guilloche patterns, adapted to encode alphanumeric data such as the personal data of the holder that are mentioned in the identity documents. Each 1D guilloche pattern is in the form of a variable undulating line, visible to the naked eye, on an underlying content, and in particular on a photograph.

According to the invention, the visual prominence is of sufficiently low intensity as not to interfere with the visual perception of the underlying content, namely the portion of the secure document located beneath the guilloche patterns—for example the photograph—although it is sufficiently marked to enable an automatic extraction even when the secure document is degraded for reasons like those previously mentioned.

Examples of a photograph of a secure document are represented in FIG. 2. Image (a) of this FIG. 2 represents a digital photograph of the holder. Image (b) of this FIG. 2 represents photograph (a) to which have been affixed guilloche patterns according to the invention. As image (b) shows, the guilloche patterns do not impede the readability of the photograph; in other words, the holder is recognizable to the naked eye, despite the presence of guilloche patterns. Security level 1 is thus ensured. Image (c) of this FIG. 2 represents an example of image (b) when it has been damaged by a print-scan method. This image (c) shows that, even in the presence of damage, the guilloche patterns inserted according to the method of the invention remain sufficiently marked as to be automatically detectable by an authentication machine, so as to ensure security level 3.

So that the guilloche patterns are inserted into the photograph in a sufficiently marked manner to ensure security level 3 while enabling readability of the photograph, the method of the invention proposes that the insertion intensity of each guilloche pattern be adapted on the basis of the gray level of the photograph. The insertion intensity is determined, for each pixel of the guilloche pattern, on the basis of the gray level of the pixels of the photograph around said guilloche pattern. According to the invention, the insertion intensity is defined by the thickness of the guilloche pattern and by the level of contrast between the photograph and said guilloche pattern.

In the method of the invention, the thickness is the number of pixels aligned in the same direction (horizontal or vertical for example) to form the guilloche pattern inserted in the photograph.

Generally speaking, the contrast is a property of an image that quantifies the difference in luminosity between the light and dark parts of the image. In the method of the invention, the contrast is the difference in luminosity between the guilloche pattern and the area of the photograph near said guilloche pattern. The contrast is a unitless value, calculated for each pixel of each guilloche pattern.

In order to calculate the contrast, the method of the invention proposes to calculate the contrast between the mid-gray level of an area inside the guilloche pattern and the mid-gray level of at least one area outside said guilloche pattern. FIG. 3 represents an example of a portion of photograph comprising an area zi inside the guilloche pattern and two areas ze outside said guilloche pattern. This portion of photograph comprises several pixels p1-pn aligned in the same direction. The internal area zi contains the pixels of a slice of the guilloche pattern. Each external area ze contains pixels of the photograph, aligned with the pixels of the internal area zi. In the example of FIG. 3, pixels p1-pn are aligned vertically because the guilloche pattern is a pattern having a sinusoidal shape extending in a broadly horizontal direction, as will be described in greater detail below.

The portion of photograph in FIG. 3 contains those of the pixels p1-pn that form the slice of the guilloche pattern. It comprises in particular pixel px, called the current pixel, the contrast of which is required to be determined. These pixels of the internal area zi constitute the thickness of the guilloche pattern. This thickness is variable. In the example of FIG. 3, the thickness is 5. It can also be, for example, 7 or 9, as in the examples of FIG. 4 previously described. The thickness of the pattern as well as the contrast—the force of insertion—are chosen on the basis of their psycho-visual impact (the guilloches must not interfere with the observation of the photograph) and robustness (the extraction of guilloche patterns must function properly, even after ageing). Furthermore, the thickness chosen is heavily dependent on the quality of the print-scan system: the print step and the scan step each have their own resolution (size of a pixel), usually worse than that of the original image. This has the effect of affecting the colors of the pixels located at the border of the guilloche pattern: the thickness of the guilloche pattern must be sufficient for the colors of the central pixels (near the axis of said guilloche pattern) to be correct, in order to prepare a future extraction.

The portion of photograph in FIG. 3 also contains external areas ze adjacent to the internal area zi. Each of these external areas ze contains the pixels of the photograph that are near the internal area zi. The number of pixels of each external area ze is predefined. In the example shown in FIG. 3, the external area ze1, like the external area ze2, contains two pixels selected in the continuity and alignment of the pixels of the internal area zi. Thus, the pixels of the external areas ze1, ze2 and of the internal area zi are aligned in the same direction. In the example in FIG. 3, the pixels of the external [areas] ze1 and ze2 are aligned vertically with the pixels of the internal area zi, above and below the internal area zi respectively, so that the guilloche pattern is broadly horizontal.

In fact, a person skilled in the art will understand that if the guilloche pattern is affixed in a horizontal direction on the photograph, a slice of said guilloche pattern contains vertically aligned pixels; the internal and external areas are then aligned vertically, as in the example shown in FIG. 3. By contrast, if the guilloche pattern is affixed in a vertical direction on the photograph, then the slice of said guilloche pattern contains horizontally aligned pixels; the internal and external areas are then aligned horizontally.

In certain embodiments, the guilloche pattern is a sinusoidal pattern, extending across the photograph horizontally or vertically, or even slanting. If the guilloche pattern is sinusoidal, the direction of said pattern is the overall crossing direction of the photograph.

In certain embodiments, the guilloche pattern can consist of ridges of an imprint, for example a fingerprint of the holder. In this case, the internal and external areas are positioned along a normal to the curve at the point in question, i.e. orthogonally to an estimated tangent direction near said point.

According to the invention, the contrast is calculated for each pixel of the internal area zi by comparing the mid-gray level of the internal area zi and the mid-gray level of the external areas ze. In the case of a color image, the mid-gray level is determined from the luminance image associated with the color image.

The comparison between the mid-gray level of the internal zone and the mid-gray level of the external zone is achieved by Logarithmic Image Processing (LIP), which is described, for example, in the publication by M. Jourlin and J-C. Pinoli, "A Model for Logarithmic Image Processing,"

Journal of Microscopy, 149 (1), pages 21-35, 1988 or in the publication by M. Jourlin, "Logarithmic Image Processing: Theory and Applications," Advances in Imaging and Electron Physics, Vol. 195, 253 p. 2016.

Thus, in each pixel of the guilloche pattern, a contrast value is calculated that is added to or subtracted from the image by LIP so as to obtain an additional LIP contrast chosen from the mid-gray levels of the internal area zi and external areas ze. The same contrast value will then be applied to all the points of the internal area zi. Thus the pixels of the same slice of guilloche pattern all have the same contrast value. However, the guilloche pattern can have a contrast value that varies from one slice to another. In other words, the same guilloche pattern can have a contrast that varies along its length. In the example shown in FIG. 2, the guilloche patterns can be more marked in the area of the person's hair than in the background areas of the image.

Figure 4:
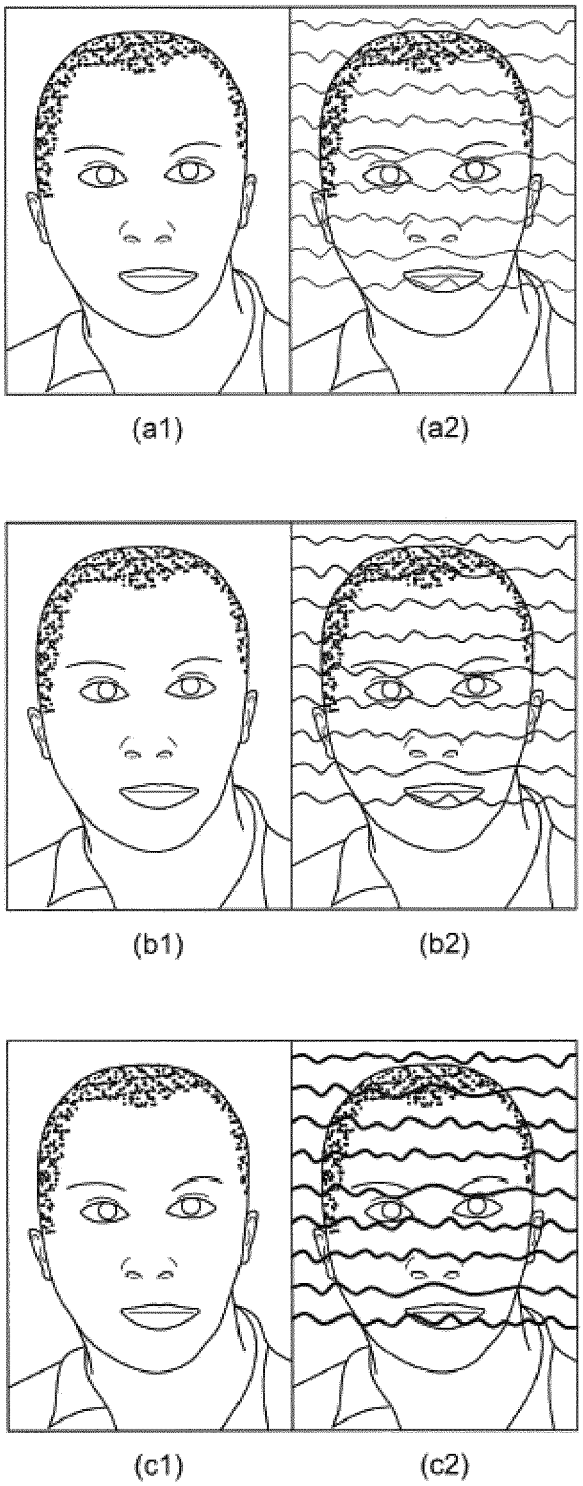
FIG. 4 represents examples of photographs with guilloche patterns inserted according to the method of the invention and, for each of these photographs, an example of the guilloche patterns detected during a level 3 security check.

FIG. 4 shows several examples of the same photograph to which are affixed guilloche patterns of different insertion intensity. Although this intensity can vary from one guilloche pattern to another, in the examples in FIG. 4 an identical insertion intensity of the guilloche patterns is chosen for all of the patterns of the same image. In these examples in FIG. 4, the insertion intensity differs from one image to the other. Images (a1), (b1) and (c1) are images, after print-scan, of the same holder. The guilloche patterns of image (a1) have a thickness of 5, which corresponds to a slice of guilloche pattern of 5 pixels aligned vertically. The guilloche patterns of image (b1) have a thickness of 7 and the guilloche patterns of image (c1) have a thickness of 9. The contrast value of each of these examples has been determined as the thicknesses, based on the quality of the print-scan system: a stronger contrast makes for an easier extraction. It will be seen that, since the guilloche patterns are inserted more intensely in image (c1) than image (a1), the person in image (c1) is clearly recognizable to the naked eye.

Images (a2), (b2) and (c2) in FIG. 4 are images after automatic detection of the guilloche patterns during a level 3 check. The guilloches visible in figures (a2), (b2) and (c2) are the guilloches detected (reconstructed) by the authentication machine during a level 3 check. It can be seen that, although the guilloche patterns are inserted less intensely in image (a1) than image (c1), the respective images (a2) and (c2) show that the detection of the guilloche patterns gives as good results with the guilloche patterns of image (a1) as with those of image (c1).

Figure 5:
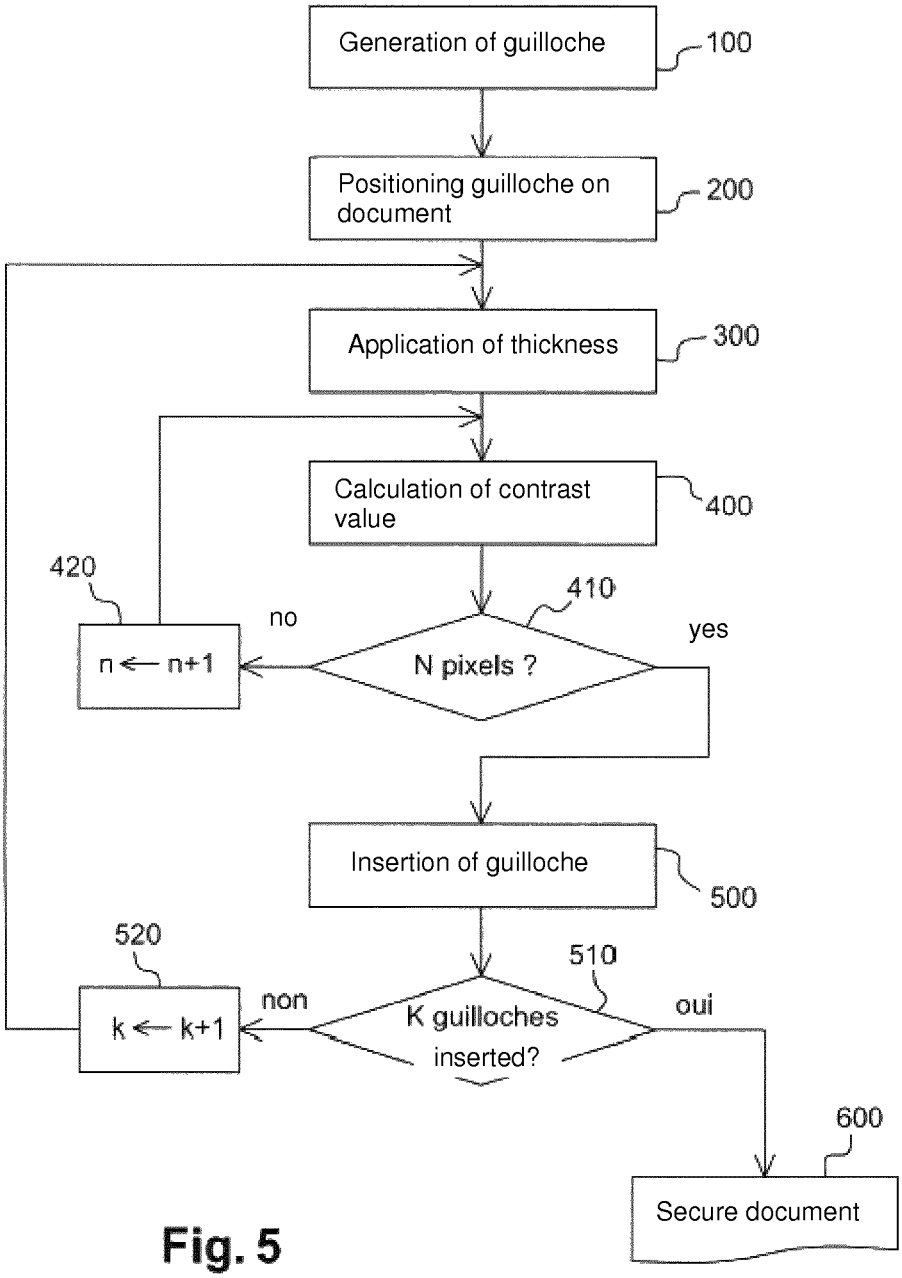
FIG. 5 represents a block diagram of an example of the insertion method according to the invention.
Figure 6:
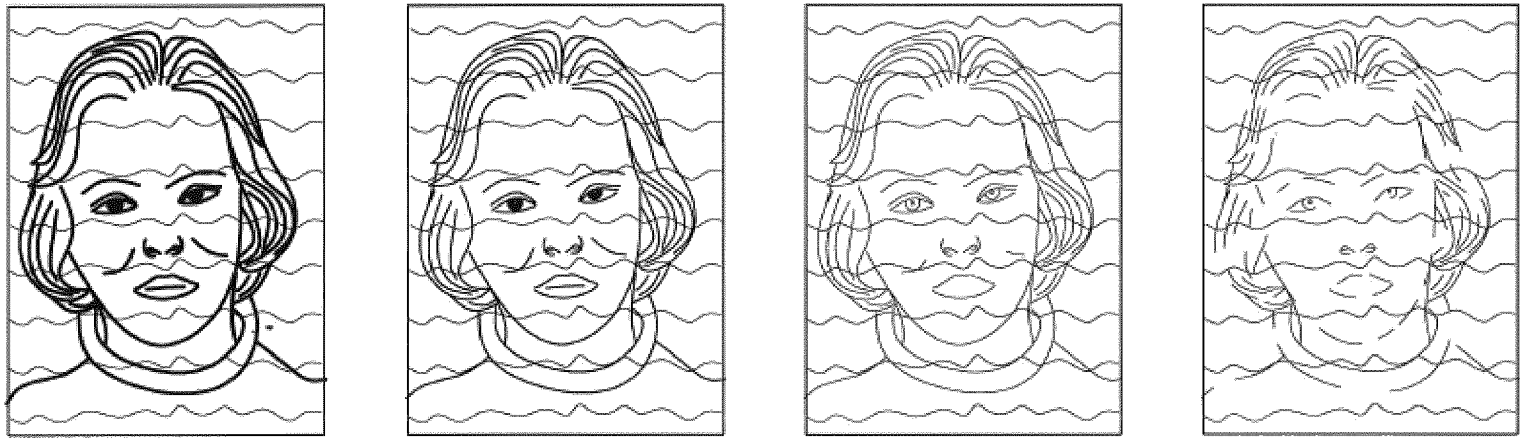
FIG. 6, previously described, represents an example of an original secure document and damaged secure documents.

FIG. 5 represents an example of a block diagram showing the different steps of the insertion method according to the invention. This method comprises a first step 100 of generation of a guilloche pattern. The guilloche pattern is a curve derived from a function, for example a sinusoidal function, that encodes alphanumeric data. Numerous documents describe methods for the generation of guilloches. The generation of guilloche patterns will not, therefore, be described in this application.

The guilloche patterns generated are then positioned—step 200—on the photograph (or other document) with a predefined spacing that depends, for example, on the number of guilloche patterns to be affixed and/or the amount of modulation used during the generation of the guilloche patterns.

The method then involves step 300 of selection and application of a guilloche thickness. When the guilloche is generated and its thickness has been defined, a step 400 of calculation of the contrast value is performed for each pixel of the guilloche. Operation 400 of calculation of the contrast value is repeated for the next n pixel (steps 410 and 420) until all of the N pixels of the guilloche pattern have been processed.

When the contrast value is determined, the guilloche is inserted in the document at step 500. The method is repeated from step 300 of application of the thickness for the next k guilloche until all of the K guilloches have been inserted in the document (steps 510 and 520). When all of the guilloches have been inserted (step 510), the document is secure (step 600).

The contrast value determined, associated with the chosen thickness of the guilloche pattern, constitutes the insertion intensity of a guilloche. The insertion intensity enables a more or less intense marking of each guilloche pattern, which directly depends on the gray level of the document onto which it is affixed. The intensity of marking is therefore directly dependent on the gray level of the document near the guilloche. This allows the underlying content to be readable with the naked eye, whatever the state of the document, and the guilloche patterns can be detected and the encoded data authenticated.

The insertion method as it has just been described can be implemented in a device for the insertion of guilloche patterns in a document. This device comprises at least one computer performing a set of instructions that prompts said computer to implement this guilloche insertion method.

The method of the invention proposes to authenticate the guilloche patterns inserted in a portion or in the entirety of a secure document such as those previously mentioned. In the description that follows, the method will be described when it is applied to a portion of a secure document such as a photograph onto which are superimposed guilloche patterns, also called guilloches. A person skilled in the art will understand that the method as it will be described can also be implemented for a document of which the entirety of said document comprises guilloche patterns. These guilloche patterns are, for example, one-dimensional patterns, or 1D guilloche patterns, adapted to encode alphanumeric data such as the personal data of the holder, mentioned in identity documents. Each 1D guilloche pattern is in the form of a variable undulating line, visible to the naked eye, on an underlying content, and in particular on a photograph, but of which the visual prominence is of sufficiently low intensity as not to interfere with the visual perception of the underlying content, namely the portion of the secure document located beneath the guilloche patterns.

Figure 7:
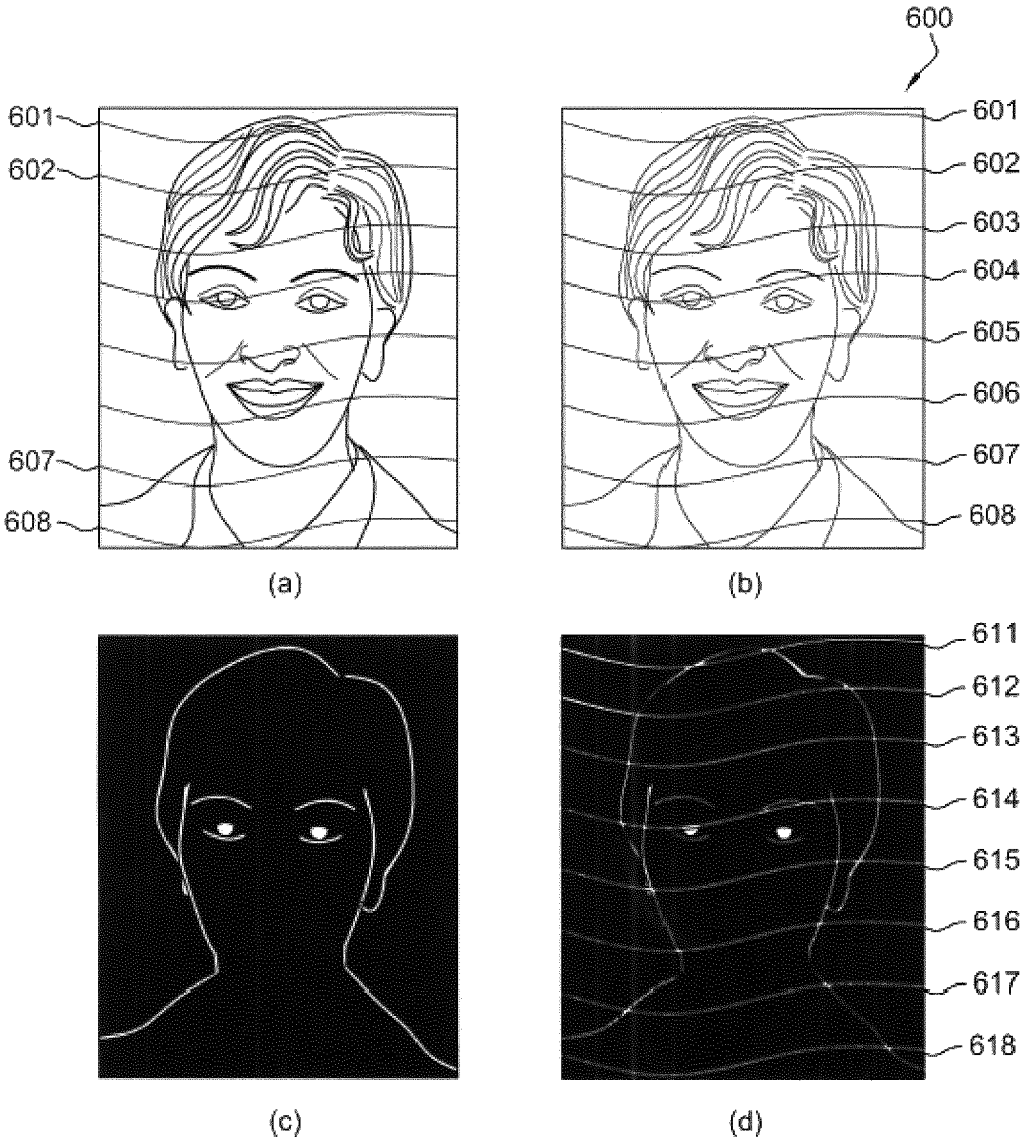
FIG. 7 represents an example of different states of a secure document during the extraction method according to the invention.

An example of a document rendered secure by guilloche patterns 601-608 is represented in image (a) of FIG. 7. In this example, the portion 600 of the secure document is a photograph onto which are superimposed 1D guilloche patterns, referenced 601-608. As the secure document 600 shows, the guilloche patterns 601-608 are a series of undulating and irregular lines, the irregularities of which correspond to coded data. The guilloche patterns 601-608 differ from one another. They are all slightly prominent, which makes it possible not to visually interfere with the main traits of the person in the photograph 600. In other words, the prominence of the guilloche patterns on the underlying content is limited so that the attention of the checker is not focused on the patterns but on said underlying content.

In the rest of the description, the underlying content onto which the guilloche patterns are affixed will be called indiscriminately photograph, underlying content or image (a).

Figure 10:
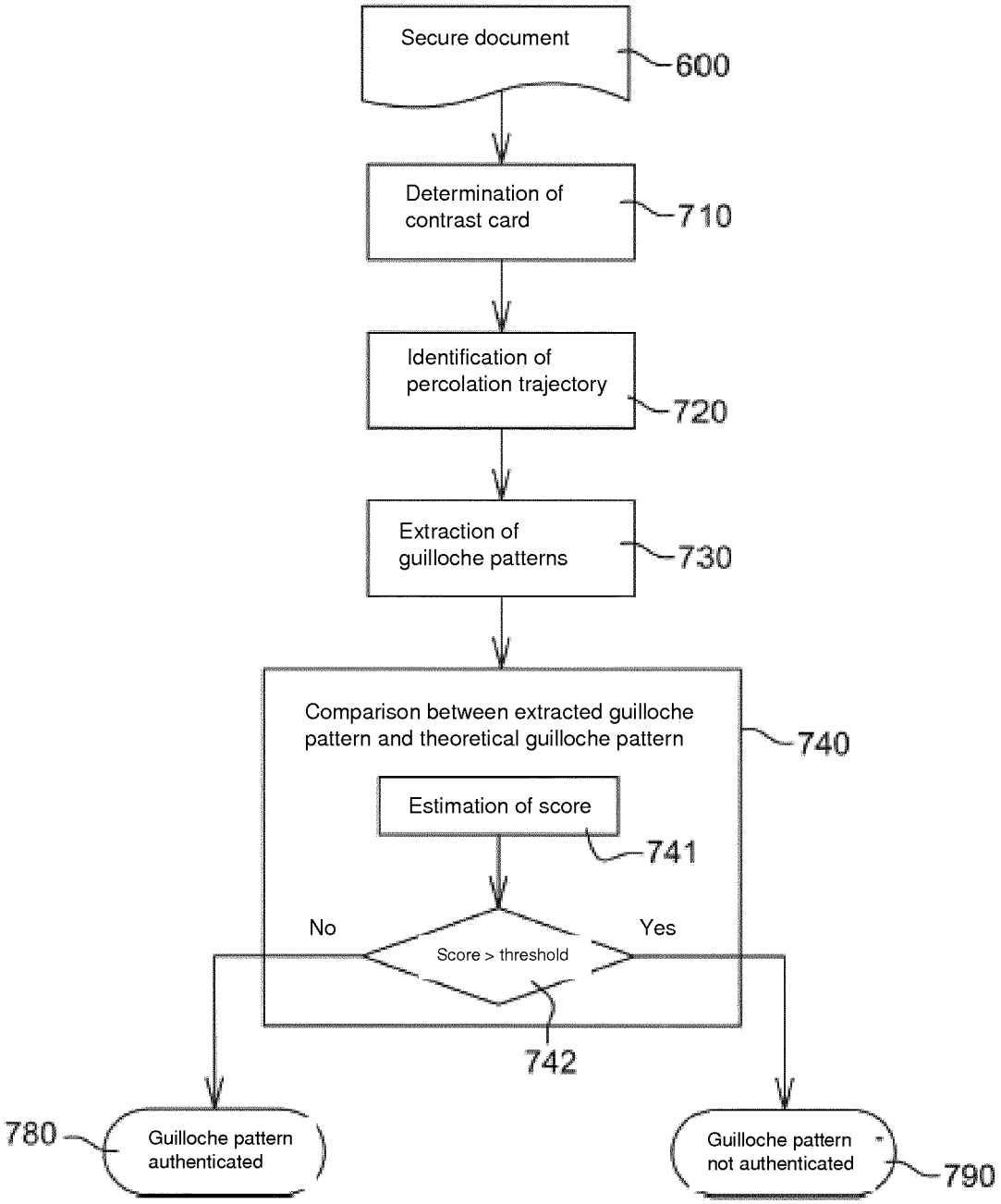
FIG. 10 represents a block diagram of an example of the authentication method according to the invention.

An example of the authentication method according to the invention is represented in FIG. 10. This method comprises several operations 710-730 enabling the guilloche patterns to be extracted from the scanned secure document 600. In fact, as previously explained, level 3 security requires, before implementing the authentication method, a print-scan phase of the secure document. Now, this print-scan phase degrades the quality of the information contained in the secure documents, and in particular that of the photograph and guilloche patterns. An example of a photograph with original guilloches, called image (a), and of the same photograph with guilloches after degradation by the print-scan phase, called image (b), are represented in FIG. 7. As the comparison between images (a) and (b) shows, the guilloche patterns of image (b) are substantially degraded compared to those of image (a), which makes the automatic extraction of these guilloche patterns more complex. In order to extract the guilloche patterns of image (b), it is therefore necessary to perform the series of operations described below.

Firstly, the extraction method according to the invention comprises an operation 710 of determination of a contrast card of the portion 600 of the secure document. This operation, which serves to reveal the contrasts along the guilloche patterns of image (b), comprises a calculation, at each point of each guilloche pattern, of the contrast between the mid-gray level of an internal area and the mid-gray level of an external area of said point. The internal area of the guilloche pattern is defined as the vertical neighborhood of the pixel in question, with a predetermined thickness, for example of two pixels, on either side of said pixel. The external area of the guilloche pattern is defined as the vertical neighborhood around the internal area, with a predetermined thickness, for example of four pixels, around said internal area.

Calculation of the contrast, according to certain embodiments, is based on LIP (Logarithmic Image Processing) described, for example, in the publication of M. Jourlin and J-C. Pinoli, "A Model for Logarithmic Image Processing," Journal of Microscopy, 149 (1), pages 21-35, 1988 or in the publication of M. Jourlin, "Logarithmic Image Processing: Theory and Applications," Advances in Imaging and Electron Physics, Vol. 195, 253 p. 2016. The general principle of this calculation of the contrast is that, in each pixel of the guilloche pattern, the supplementary LIP contrast chosen between the mid-gray values of the internal area of the guilloche pattern and the external area is calculated.

The calculation of the contrast at each point of the guilloche patterns enables a contrast card to be created, as represented by image (c) of FIG. 7.

When the document, and particularly the photograph, is in color, the contrast card is calculated on the basis of the luminance image associated with the color image. For this, a luminance image (in gray levels) calculated on the basis of the three color planes is extracted beforehand.

The extraction method then involves an identification operation 720, on this contrast card, of the optimal percolation trajectory. According to certain embodiments, this operation 720 involves an identification of all of the percolation trajectories likely to cross the image (c) in order to connect a point of departure of a guilloche pattern to a point of arrival of said guilloche pattern. In fact, the 1D guilloche patterns are positioned, in the secure document, according to a horizontal overall direction. Each guilloche pattern therefore crosses the image from one side to the other, from left to right. The method then proposes to find, within the contrast image (c), all of the trajectories that cross the image from left to right. A person skilled in the art will understand that in the case where the guilloche patterns have a non-horizontal overall direction, for example vertical or slanting, the points of departure and the points of arrival of the percolation trajectories sought are not necessarily on the left and right of the image but, for example, at the top and bottom of the image.

The method then proposes to determine, among all of the detected percolation trajectories, the optimal percolation trajectory, i.e. the trajectory that has the most preferred direction. This detection of the optimal percolation trajectory is achieved by calculating a cost function for each of the trajectories and by determining the minimal cost function. The cost function of a trajectory corresponds to the variability of the contrast between the contrast determined for each trajectory and an expected contrast, previously determined. The closer the contrast to the expected contrast, the lower the cost function. The cost function therefore favors points that have contrast levels near the contrast value chosen for the insertion of the guilloche pattern into the secure document. The optimal percolation trajectory is therefore, among all the detected percolation trajectories, the one that has the smallest cost function.

According to the method, this optimal percolation trajectory is deemed to be the guilloche pattern. The guilloche pattern is then extracted (step 730 of FIG. 10) once the optimal percolation trajectory has been determined. In the example of FIG. 7, image (d) shows the optimal percolation trajectories, i.e. the guilloche patterns 611-618 resulting from the contrast image (c). A comparison of image (d) with image (a) of FIG. 7 shows that the guilloche patterns 611-618 extracted with the method previously described—image (d) —are close to the original guilloche patterns 601-608 of image (a). These extracted guilloche patterns 611-618, although resulting from an image (b) where they are barely visible, can be used at security level 3. An authentication of these guilloche patterns can then be implemented.

The authentication method according to the invention comprises an operation 740 of comparison of each extracted guilloche pattern with the corresponding theoretical guilloche pattern. According to certain embodiments, the theoretical guilloche pattern is the original guilloche pattern, i.e. the one that was generated initially and affixed onto the content of the document to be rendered secure. At the moment of authentication of the guilloche pattern, the extracted guilloche pattern (for example pattern 618) is compared to the corresponding guilloche pattern that is stored in the chip (for example pattern 608). The comparison of each of the extracted guilloche patterns with the original guilloche patterns makes it possible to determine whether the secure document has been forged.

In other embodiments, the theoretical guilloche pattern is obtained by means of optical character recognition (OCR), achieved for example during scanning of the secure document. In these embodiments, the alphanumeric data mentioned in the secure document alongside the image (a) are determined by optical recognition and theoretical guilloche patterns are generated on the basis of these recognized alphanumeric data. The extracted guilloche patterns are then compared to these theoretical guilloche patterns and their comparison makes it possible to determine whether the secure document has been forged.

Figure 8:
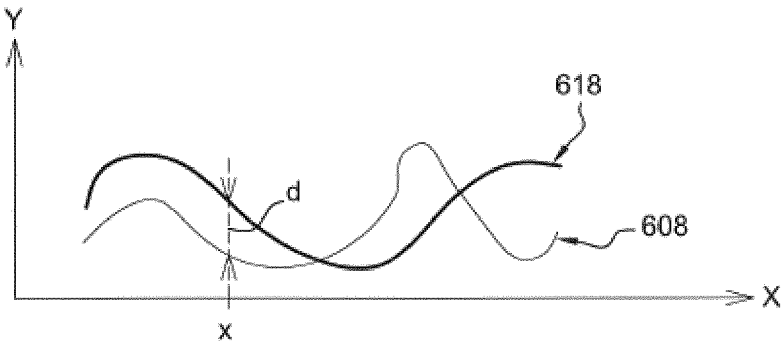
FIG. 8 represents an example of an extracted guilloche pattern and a theoretical guilloche pattern.

Whatever the technique used to obtain theoretical guilloche patterns, the extracted guilloche patterns are compared with the theoretical guilloche patterns, for example by superimposing said extracted patterns and said theoretical patterns. This comparison can be based on an estimation of a score calculated for each pair of guilloche patterns, a pair consisting of one extracted guilloche pattern and one theoretical pattern. This operation of estimating the score, referenced 741 in FIG. 10, can be achieved by calculating, at each point of the x-axis (when the guilloche patterns extend horizontally), the distance separating the extracted guilloche pattern and the theoretical guilloche pattern. Thus, in an XY coordinate system, the score at a point x of the X axis corresponds to the distance along the Y axis between the extracted guilloche pattern and the theoretical guilloche pattern. This distance is preferably calculated in number of pixels. An example of calculation of the score at a point x is represented in FIG. 8. In this example, at point x of the X axis, the distance—referenced d—separating the extracted guilloche pattern 618 from the theoretical guilloche pattern 608 is the length along axis Y between the two patterns 608 and 618. The scores calculated at each point of the X axis, for a pair of guilloche patterns, are added together to constitute the score of the extracted guilloche pattern. The lower the score, the closer the extracted guilloche pattern to the theoretical guilloche pattern. In FIG. 10, the comparison of the score with a predetermined threshold is represented by step 742. Below a predefined score threshold, the guilloche pattern is considered to be authenticated (block 780 of FIG. 10). Above the predefined score threshold, the guilloche pattern is considered as not authenticated (block 790 of FIG. 10).

Figure 9:
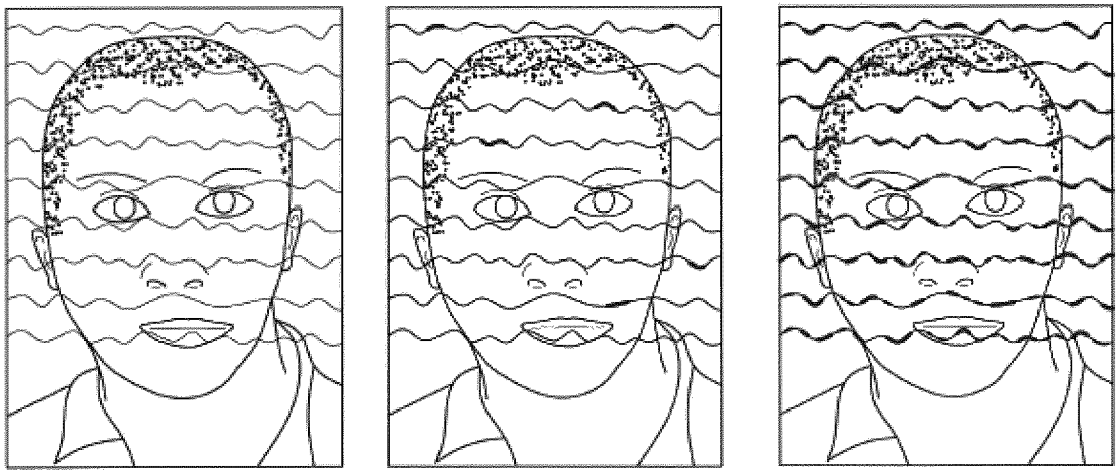
FIG. 9 represents examples of authenticable secure documents and non-authenticable secure documents according to the method of the invention.

The scores of all of the pairs of guilloche patterns can also be added together to authenticate or not authenticate the secure document as a whole. Two examples of images (b) after print-scan are shown in FIG. 9, each of these images (b) being associated with an example of an authenticated image (e) and an example of a non-authenticated image (f). Each of the images (e) and (f) contain, superimposed on the photograph, the theoretical guilloche patterns completed by the distances between the extracted and theoretical guilloche patterns. This distance is symbolized by the thickness of the guilloche line. In the case of images (e), the lines representing the guilloche patterns are not very thick. The aggregate score is below or equal to the predetermined threshold. Image (e) is authenticated. By contrast, on the images (f), the lines representing the guilloche patterns are thick for a considerable length of each pattern. The aggregate score exceeds the predetermined threshold. Image (f) is not authenticated.

In certain embodiments, a weight is assigned to each score before being totaled. In fact, as the extraction is not usually perfect, it is normal that small distances exist between the two patterns of the same pair of guilloche patterns, as is the case in the example of images (e) of FIG. 9. By contrast, when the distances are long, as in the example of images (f) of FIG. 9, forgery is suspected. The method therefore proposes to assign a bigger weighting to long distances than to short distances so as to optimize the aggregate score. A "long distance" is a distance between one point of an extracted guilloche pattern and the corresponding point (for example on the same axis) of the theoretical guilloche pattern, which generates an excess thickness of the guilloche. By contrast, a "short distance" does not cause excess thickness in the guilloche.

It is in this way that, in certain variations, the points assigned to the scores can be adjustable. For example, they can be proportional to the square of the distance, to its exponential, etc. such as to maximize the aggregate score and make forged guilloche patterns easier to detect.

Although described through a certain number of examples, variations and embodiments, the method of insertion of guilloche patterns according to the invention comprises different variations, modifications and improvements that will appear clear to a person skilled in the art, it being understood that these variations, modifications and improvements form part of the scope of the invention.

Although described through a certain number of examples, variations and embodiments, the methods of extraction and authentication of guilloche patterns according to the invention comprise different variations, modifications and improvements that will appear clear to a person skilled in the art, it being understood that these variations, modifications and improvements form part of the scope of the invention.

The invention claimed is:

1. A method of inserting guilloche patterns in a document, each guilloche pattern consisting of a plurality of pixels and being capable of encoding variable alphanumeric data ensuring a different aspect at each guilloche pattern so as to render said document secure, the method comprising:

determining an insertion intensity of each guilloche pattern previously generated based on a mid-gray level of the document adjacent to said guilloche pattern and the insertion intensity of said guilloche pattern comprises a contrast value and a thickness of said guilloche pattern, the determination comprising calculating, in each pixel of said guilloche pattern, the contrast value between an internal area of the guilloche pattern and an external area adjacent to said internal area.

2. The method of inserting guilloche patterns according to claim 1, wherein the contrast value is obtained by comparing the mid-gray level of the internal area and the mid-gray area of the external area.

3. The method of inserting guilloche patterns according to claim 2, wherein the comparison between the mid-gray level of the internal area and the mid-gray level of the external area is achieved by logarithmic image processing.

4. The method of inserting guilloche patterns according claim 1, wherein determining the insertion intensity of the guilloche pattern comprises selecting a thickness of the guilloche pattern.

5. The method of inserting guilloche patterns according to claim 1, wherein the external area is an area of pixels adjacent to the internal area.

6. The method of inserting guilloche patterns according to claim 1, wherein the guilloche pattern is a sinusoidal pattern, affixed substantially horizontally to the document, the external area being positioned vertical to the pixel of the guilloche pattern.

7. The method of inserting guilloche patterns according to claim 1, wherein the guilloche pattern is a series of pixels located on curves corresponding to a digital fingerprint, the internal and external areas being positioned along a normal to the curve at the pixel in question.

8. A device for inserting guilloche patterns into a document, comprising:

a computer containing a set of instructions that prompt said computer to implement a method for inserting guilloche patterns in a document, each guilloche pattern consisting of a plurality of pixels and being capable of encoding variable alphanumeric data ensuring a different aspect at each guilloche pattern so as to render said document secure, by determining an insertion intensity of each guilloche pattern previously generated based on a mid-gray level of the document adjacent to said guilloche pattern and in that the insertion intensity of said guilloche pattern involves a contrast value and a thickness of said guilloche pattern calculating, in each pixel of said guilloche pattern, the contrast value between an internal area of the guilloche pattern and an external area adjacent said internal area.

9. A secure document onto which are affixed guilloche patterns encoding alphanumeric data, wherein the guilloche patterns are inserted into the document by a method for inserting guilloche patterns in a document, each guilloche pattern consisting of a plurality of pixels and being capable of encoding variable alphanumeric data ensuring a different aspect at each guilloche pattern so as to render said document secure, by determining an insertion intensity of each guilloche pattern previously generated based on a mid-gray level of the document adjacent to said guilloche pattern and the insertion intensity of said guilloche pattern comprises a contrast value and a thickness of said guilloche pattern, said determination comprises calculating, in each pixel of said guilloche pattern, the contrast value between an internal area of the guilloche pattern and an external area adjacent said internal area.

10. The secure document of claim 9 wherein the secure document is an identity document.

11. A method for extracting guilloche patterns from a secure document prone to be degraded, the method comprising:

determining a contrast card of at least one portion of the secure document that includes the guilloche patterns;

identifying, on this contrast card an optimal percolation trajectory; and extracting the optimal percolation trajectory, said optimal percolation trajectory is deemed to correspond to the guilloche patterns.

12. The method for extracting guilloche patterns according to claim 11, wherein the contrast card is created by means of a logarithmic image processing model.

13. The method for extracting guilloche patterns according to claim 11, wherein the operation of identifying the optimal percolation trajectory further involves:

identifying, on the contrast card, all trajectories likely to pass across the secure document in order to connect a point of departure of a guilloche pattern to a point of arrival of said pattern;

determining a contrast at each point of each said all trajectories;

determining a cost function of each of said all trajectories, said cost function assessing a variability of the contrast between the contrast determined at each point of each said trajectory and an expected contrast at each said point of said trajectory;

comparing the cost functions of all of the trajectories; and extracting a guilloche pattern by determining which of said all trajectories has the minimal cost function, the trajectory having the minimal cost function deemed to correspond to the guilloche pattern.

14. The method for extracting guilloche patterns according to any of claim 11, wherein when the secure document is in color, the contrast card is calculated based on a luminance image associated with the color document.

15. The method of extracting guilloche patterns, according to claim 11, further comprising:

authenticating the guilloche patterns of the secure document prone to be degraded by comparing each extracted guilloche pattern with a corresponding theoretical guilloche pattern.

16. The method of extracting guilloche patterns according to claim 15, wherein each guilloche pattern encodes variable alphanumeric data mentioned in said secure document, wherein the theoretical guilloche pattern is obtained by optical character recognition of the alphanumeric data mentioned in the secure document and by generating the corresponding theoretical patterns.

17. The method of extracting guilloche patterns according to claim 15, wherein the secure document comprises an electronic chip, wherein the theoretical guilloche pattern is an original guilloche pattern, previously stored in the chip when generating the guilloche pattern affixed to the secure document.

18. The method of extracting guilloche patterns according to any of claim 15, wherein the operation of comparing the extracted and theoretical patterns involves estimating a score based on a distance between each point of the extracted guilloche pattern and a corresponding point of the theoretical guilloche pattern.

19. The method of extracting guilloche patterns according to claim 18, wherein the score is calculated by accumulating the distances for all of the points of the guilloche pattern.

20. The method of extracting guilloche patterns according to claim 18, wherein the distance between each point of the extracted guilloche pattern and the corresponding point of the theoretical guilloche pattern is calculated as the number of pixels between each point of the extracted guilloche pattern and the corresponding point of the theoretical guilloche pattern.

21. The method of extracting guilloche patterns according to claim 18, wherein a weight is assigned to each distance, depending on the length of the each distance.

22. The method of extracting guilloche patterns according to claim 21, wherein the weight assigned to each distance can be adjusted.

23. A computer containing a set of instructions that prompt said computer to implement a method for authenticating guilloche patterns of a secure document prone to be degraded by:

determining a contrast card of at least one portion of the secure document that includes the guilloche patterns;

identifying, on this contrast card an optimal percolation trajectory;

extracting the optimal percolation trajectory, said trajectory corresponding to the guilloche pattern; and authenticating the guilloche patterns of the secure document prone to be degraded by comparing each extracted guilloche pattern with a corresponding theoretical guilloche pattern.

24. An identity document comprising alphanumeric data relating to a holder associated with the identity document and an identity photograph to which are affixed guilloche patterns encoding the alphanumeric data, wherein the guilloche patterns can be authenticated by determining a contrast card of at least one portion of the secure document that includes the guilloche patterns;

identifying, on this contrast card an optimal percolation trajectory;

extracting optimal percolation trajectory, said trajectory corresponding to the guilloche pattern; and authenticating the guilloche patterns of the secure document prone to be degraded by comparing each extracted guilloche pattern with a corresponding theoretical guilloche pattern.

* * * * *